US009449589B2

(12) United States Patent
Ikeda

(10) Patent No.: US 9,449,589 B2
(45) Date of Patent: Sep. 20, 2016

(54) TOUCH DETECTING DEVICE, ELECTRONIC MUSICAL INSTRUMENT, TOUCH DETECTING METHOD AND STORAGE MEDIUM

(71) Applicant: CASIO COMPUTER CO., LTD., Shibuya-ku (JP)

(72) Inventor: Akira Ikeda, Mitaka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/820,086

(22) Filed: Aug. 6, 2015

(65) Prior Publication Data

US 2016/0042728 A1 Feb. 11, 2016

(30) Foreign Application Priority Data

Aug. 11, 2014 (JP) ..... 2014-163686

(51) Int. Cl.
*G10H 1/32* (2006.01)
*G10H 3/00* (2006.01)
*G10H 1/34* (2006.01)

(52) U.S. Cl.
CPC ..... *G10H 1/34* (2013.01); *G10H 2220/285* (2013.01)

(58) Field of Classification Search
CPC ..... G10H 2220/285; G10H 1/34
USPC ..... 84/744
See application file for complete search history.

(56) References Cited

U.S. PATENT DOCUMENTS 4,668,843 A * 5/1987 Watanabe ..... G10H 1/344 200/1 B
6,849,796 B2 * 2/2005 Yamaguchi ..... G10H 1/344 84/720
7,319,187 B2 1/2008 Sunako
8,134,060 B2 * 3/2012 Taniguchi ..... G10H 1/346 84/423 R
8,766,081 B2 * 7/2014 Sakata ..... G10H 1/344 84/662
8,927,848 B2 * 1/2015 Kaneko ..... G10H 1/34 84/720
9,029,679 B2 * 5/2015 Sakata ..... G10H 1/34 84/744
2003/0131720 A1 * 7/2003 Sakurada ..... G10H 1/346 84/719
2005/0016369 A1 1/2005 Sunako
2011/0239846 A1 * 10/2011 Shimoda ..... G10H 1/344 84/687
2013/0074684 A1 * 3/2013 Iwase ..... G10H 1/346 84/745
2013/0239786 A1 9/2013 Sakata

FOREIGN PATENT DOCUMENTS

JP 2005-43553 2/2005
JP 2013-195647 9/2013

* cited by examiner

*Primary Examiner* — Jeffrey Donels
(74) *Attorney, Agent, or Firm* — Cozen O'Connor

(57) ABSTRACT

First and third counters count an ON time between first and second contact nodes of a key and an ON time between the second contact node and a third contact node, respectively. A second counter counts a time after counting of the first counter is completed. A counter memory stores velocity counter values representing count times of the first and third counters, and a correction time counter value representing the count time of the second counter. An arrival comparator circuit compares an arrival time value and the correction time counter value. In a case that the velocity count value of the first counter is larger than a threshold value, when the arrival comparator circuit detects that the arrival time value coincides with the correction time counter value, a controller outputs a sound generation instruction including touch information according to the velocity counter value loaded from the counter memory.

19 Claims, 9 Drawing Sheets

FIG. 3

| | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
|---|---|---|---|---|---|---|---|---|---|---|---|---|---|---|---|---|---|---|---|---|
| 0 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 1 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| ..... | | | | | | | | | | | | | | | | | | | | |
| 81 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 82 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 83 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 84 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 85 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 86 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 87 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| | EV | | ST | | VC | | | | | | | | TC | | | | | | | |

FIG. 9

| | [VELOCITY BETWEEN FIRST AND SECOND CONTACT NODES] ≤ α | [VELOCITY BETWEEN FIRST AND SECOND CONTACT NODES] < α |
|---|---|---|
| PRESSED KEY DOES NOT REACH THIRD CONTACT NODE | SOUND IS NOT GENERATED (※ FIG. 6) | SOUND IS GENERATED BY VELOCITY BETWEEN FIRST AND SECOND CONTACT NODES (※ FIG. 5) |
| PRESSED KEY REACHES THIRD CONTACT NODE | SOUND IS GENERATED BY VELOCITY BETWEEN SECOND AND THIRD CONTACT NODES (※ FIG. 7) | SOUND IS GENERATED BY VELOCITY BETWEEN FIRST AND SECOND CONTACT NODES (※ FIG. 8) |

TOUCH DETECTING DEVICE, ELECTRONIC MUSICAL INSTRUMENT, TOUCH DETECTING METHOD AND STORAGE MEDIUM

CROSS-REFERENCE TO RELATED APPLICATIONS

This application is based upon and claims the benefit of priority from the prior Japanese Patent Application No. 2014-163686, filed on Aug. 11, 2014, and the entire contents of which are incorporated herein by reference.

BACKGROUND OF THE INVENTION

1. Field of the Invention

The present invention relates to a device, method, and storage medium for detecting touch operations on a keyboard of an electronic musical instrument, and the electronic musical instrument.

2. Description of the Related Art

In order to detect the velocity of a key of an electronic musical instrument, it is general to provide two switches (contact nodes) below the key such that the switches are turned on by different press amounts (strokes), and measure a different between the ON times of the switches, and uses the different as velocity information. The measurement starts when a first switch is turned on and finishes when a second switch is turned on. Thereafter, in response to a key press strength obtained from data obtained by the measurement, the tone and volume of a sound source is controlled, whereby a sound generation process is performed (for example, a technology disclosed in JP-A-2013-195647).

Recently, it also has been proposed a related technology capable of performing sound source control which simulated a damper operation of a piano by additionally providing one switch at an intermediate stroke position between two switches (for example, a technology disclosed in JP-A-2005-043553). Here, when the switches are referred to as first, second, and third switch from the shallowest position (the position closest to a key), a structure for detecting key press (touch) strength by the second and third switches is the same as the technology disclosed in JP-A-2013-195647, but it is possible to detect a repetition of key pressing with a small stroke amplitude at the shallow position between the second switch and the third switch, like in an acoustic piano. Also, sound muffling is performed by turning off the first switch while keeping a stroke position according to the related art.

Considering a structure of an acoustic piano, damper-on control (sound muffling control) is performed by the first switch, and a key press velocity and sound generation start timing are controlled by the second and third switches. Therefore, by repeatedly turning on and off the second and third switches while keeping the first switch in an ON state (a damper release state), it is possible to implement overlapping of various tones close to repetitions of key striking on an acoustic piano. This is effective in repeatedly hitting one note or trilling, and is now used.

It is known that, since even though a key is pressed to a lower limit position by a key pressing operation on an acoustic piano, when the key is pressed to a position above the third switch at a constant velocity or higher, a hammer being in contact with an action part of the key gets off the action part, and moves and strikes a string by inertia, it is possible to generate a sound by pressing a key to such a shallow position.

However, according to electronic keyboard instrument technologies of the related art, pressing a key to a position above the third switch is not considered as a key pressing operation. Therefore, there is a problem that a sound might not be generated against player's intention and key press detection performance and performance relating to repetitions of key pressing might be damaged.

SUMMARY OF THE INVENTION

An object of the present invention is to implement detection of key pressing or a repetition of key pressing with a higher degree of accuracy.

A touch detecting device includes a first counter and a control circuit. The first counter counts a count value corresponding to a time from when a first contact node is turned on to when a second contact node is turned on in a case that at least two of the first contact node, the second contact node, and a third contact node are sequentially turned on according to a key pressing operation. The control circuit outputs a sound generation instruction signal regardless of whether the third contact node is turned on or off, in a case that the count value counted by the first counter is less than a threshold value. The control circuit outputs a sound generation instruction signal after the third contact node is turned on, in a case that the count value counted by the first counter is not less than the threshold value.

BRIEF DESCRIPTION OF THE DRAWING

FIG. 3 is a view illustrating an example of a data configuration of a counter memory.

FIG. 9 is a table illustrating a summary of the operations of the embodiment.

DETAILED DESCRIPTION OF THE PREPARED EMBODIMENT

Hereinafter, a touch detecting device according to an embodiment of the present invention will be described with reference to the accompanying drawings.

Figure 1:
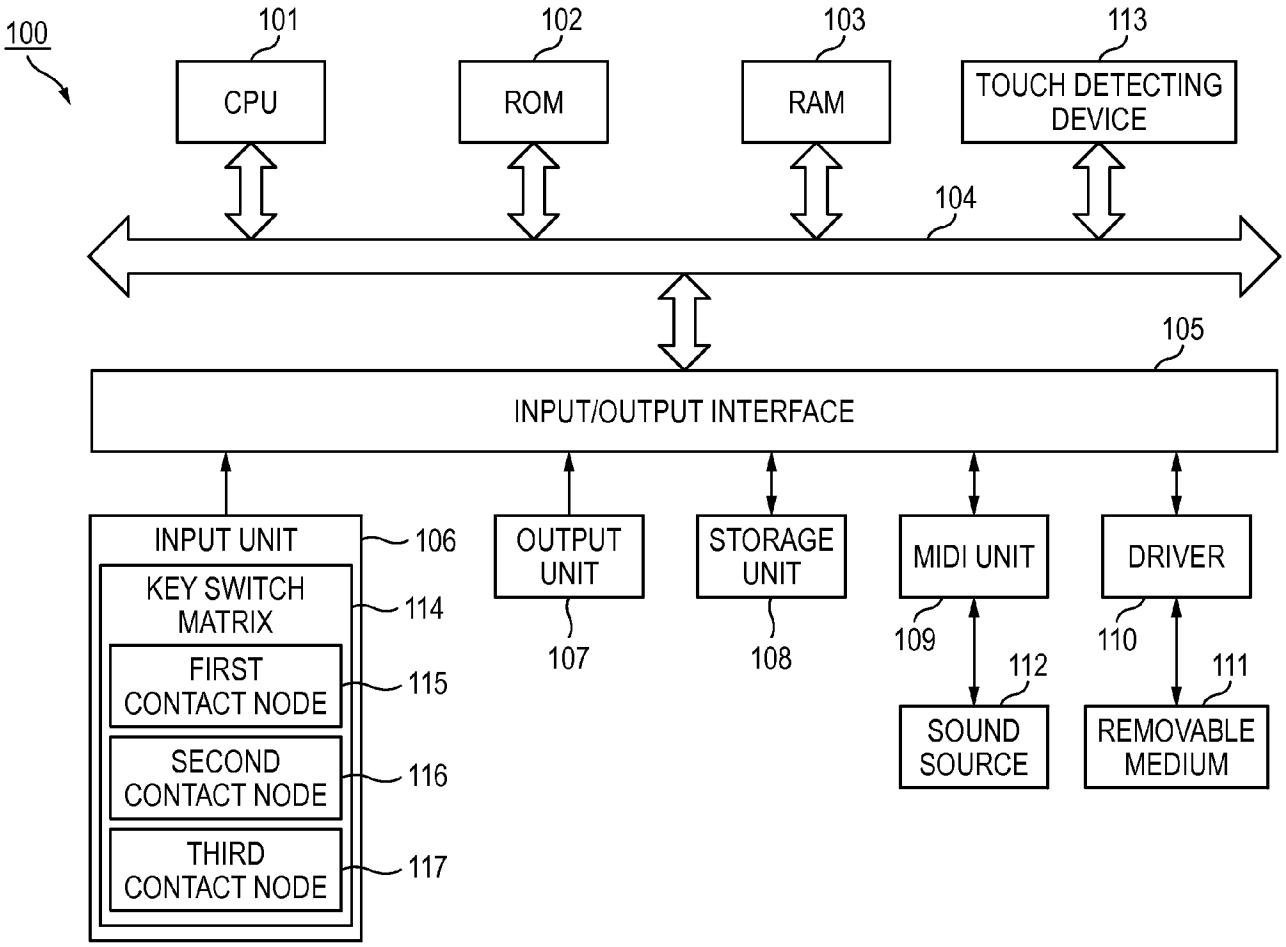
FIG. 1 is a view illustrating an example of a hardware configuration of an electronic musical instrument according to an embodiment.

FIG. 1 is a block diagram illustrating an example of a hardware configuration of an electronic musical instrument 100 using a touch detecting device 113 according to an embodiment of the present invention.

In FIG. 1, the electronic musical instrument 100 includes a CPU 101, a read only memory (ROM) 102, a random access memory (RAM) 103, a bus 104, an input/output interface 105, an input unit 106, an output unit 107, a storage unit 108, a musical instrument digital interface (MIDI) unit 109, a driver 110, and the touch detecting device 113.

The CPU 101 performs various processes according to programs recorded in the ROM 102 or programs loaded from the storage unit 108 into the RAM 103. For example, the CPU 101 performs control for generating a sound, that is, sound generation control, on the basis of sound generation information (to be described below in detail) transmitted from the touch detecting device 113. In the RAM 103, data and the like necessary for the CPU 101 to perform various processes are appropriately stored.

The CPU 101, the ROM 102, the RAM 103, and the touch detecting device 113 (to be described below) are connected to one another through the bus 104. The bus 104 is also connected to the input/output interface 105. The input/output interface 105 is connected to the input unit 106, the output unit 107, the storage unit 108, the MIDI unit 109, and the driver 110.

The input unit 106 includes a MIDI keyboard, which has a plurality of keys (for example, 88 keys) associated with a plurality of notes, respectively. In the electronic musical instrument 100, the plurality of notes associated with the plurality of keys is identifying by note numbers. A key pressing or releasing operation is detected by the touch detecting device 113 (to be described below).

Specially, the input unit 106 includes a key switch matrix 114, wherein first contact nodes 115, second contact nodes 116, and third contact nodes 117 are provided for the plurality of keys, respectively, and are connected in a matrix, and are sequentially turned on according to key pressing operations. That is, from the shallowest positions (positions closest to the keys), the first contact nodes 115, the second contact nodes 116, and the third contact nodes 117 are disposed in sequence.

The key switch matrix 114 detects first contact nodes 115, second contact nodes 116, or third contact nodes 117 which are on, according to a common side switch input signal (KC) transmitted from the touch detecting device 113. Thereafter, the key switch matrix 114 transmits first contact node ON signals representing that the first contact nodes 115 are on, second contact node ON signals representing that the second contact nodes 116 are on, and a third contact node ON signals representing that the third contact nodes 117 are on, to the touch detecting device 113.

Meanwhile, when a key is released from its pressed state, the key switch matrix 114 detects that a third contact node 117, a second contact node 116, and a first contact node 115 are sequentially turned off. Thereafter, the key switch matrix 114 transmits a first contact node OFF signal, a second contact node OFF signal, and a third contact node OFF signal representing that the first contact node 115, the second contact node 116, and the third contact node 117 have been turned off, respectively, to the touch detecting device 113.

Also, the input unit 106 includes switches for inputting a variety of information. Further, the input unit 106 outputs a variety of information input by a user, to the CPU 101.

The output unit 107 includes a display, a speaker, a D/A converter circuit, and the like, and outputs images and sounds.

The storage unit 108 is composed of a hard disk, a dynamic random access memory (DRAM), or the like, and stores various programs for control of the electronic musical instrument 100.

The MIDI unit 109 is an interface connecting a sound source 112 for generating musical sounds and the CPU 101 which acts as a sound generation control unit. The sound source 112 stores sound source data associated with the note numbers for identifying the plurality of notes associated with the plurality of keys of the input unit 106, respectively, and reads the sound source data and outputs musical sounds according to control of the CPU 101.

In the driver 110, a removable medium 111 which is composed of a semiconductor memory (such as an SD memory or a compact flash memory), a magnetic disk, an optical disk, a magneto-optical disk, or the like is appropriately loaded. A program read from the removable medium 111 by the driver 110 is installed in the storage unit 108 when necessary. Also, the removable medium 111 can store a variety of data stored in the storage unit 108, like the storage unit 108.

Figure 2:
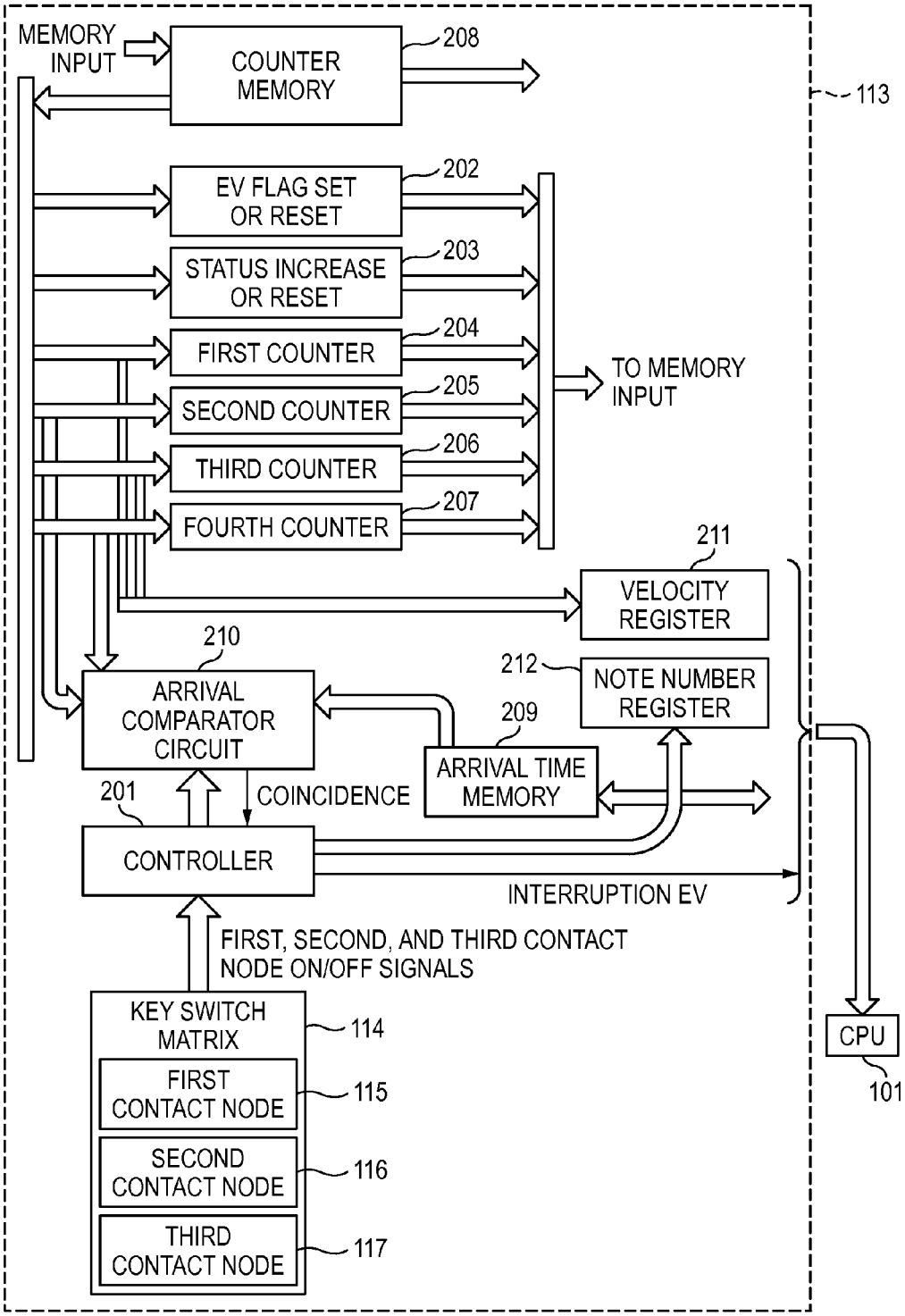
FIG. 2 is a view illustrating an example of a hardware configuration of a touch detecting device according to the embodiment.

Now, a hardware configuration of the touch detecting device 113 according to the present embodiment will be described with reference to FIG. 2. FIG. 2 is a block diagram illustrating an example of the hardware configuration of the touch detecting device 113 according to the present embodiment. The touch detecting device 113 includes a controller 201 which is a control circuit, an event flag set circuit 202 (hereinafter, also referred to as an "EV flag set circuit 202"), a status update circuit 203, a first counter adder (referred to as "FIRST COUNTER" in FIG. 2) 204, a second counter adder (referred to as "SECOND COUNTER" in FIG. 2) 205, a third counter adder (referred to as "THIRD COUNTER" in FIG. 2) 206, a fourth counter adder (referred to as "FOURTH COUNTER" in FIG. 2) 207, a counter memory 208, an arrival time memory 209, an arrival comparator circuit 210, a velocity register 211, and a note number register 212.

The first counter adder 204, the second counter adder 205, the third counter adder 206, and the fourth counter adder 207 are configured so as to count clock pulses with a predetermined cycle output from an oscillator. Therefore, the count values of them correspond to times.

The controller 201 is connected to the first contact nodes 115, the second contact nodes 116, and the third contact nodes 117 of the key switch matrix 114 of FIG. 1, and receives first contact node ON signals, second contact node ON signals, and the third contact node ON signals. Also, the controller 201 controls the other hardware of the touch detecting device 113, and generates sound generation information to cause the CPU 101 acting as the sound generation control unit to generate sounds, and transmits the sound generation information to the sound generation control unit through the bus 104.

In the present embodiment, sound generation information includes interruption information related to processes of the CPU 101, the note number of a key of the input unit 106 in a case that the corresponding key has been pressed, and a velocity value which is touch information representing the strength of the key pressing. When the CPU 101 acting as the sound generation control unit receives the sound generation information, it performs control to generate a sound corresponding to the note number included in the corresponding sound generation information, with strength according to the velocity, in cooperation with the sound source 112.

Also, the controller 201 transmits the common side switch input signal (KC) to the key switch matrix 114, and receives first contact node ON signals, second contact node ON signals, and third contact node ON signals from the key switch matrix 114.

Also, the controller 201 controls the circuits and adders constituting the touch detecting device 113, according to event flags (hereinafter, also referred to as "EV flags") (to be described below) and status flags (hereinafter, also referred to as "ST flags") stored in the counter memory 208. The controller 201 stores the values of the EV flags and the ST flags in the counter memory 208, and appropriately refers to those values, and controls the EV flag set circuit 202 and the status update circuit 203 such that they update those values.

FIG. 3 is a view illustrating an example of a data configuration of the counter memory 208 of FIG. 2. The counter memory 208 retains a plurality of addresses corresponding to the plurality of keys, respectively. Specially, in the present embodiment, the counter memory retains 88 addresses from 0 to 87 corresponding to 88 keys, respectively. For each address, an EV flag value, an ST flag value, a velocity counter value, and a correction time counter value with regard to a key associated with the corresponding address are stored.

A velocity counter value (hereinafter, also referred to as a "VC value") is added by the first counter adder 204 or the third counter adder 206 of FIG. 2, and a correction time counter value (hereinafter, also referred to as a "TC value") is added by the second counter adder 205 or the fourth counter adder 207 of FIG. 2, as will be described below in detail. Also, for each address, a note number (not shown) associated with a corresponding key is stored. For each VC value, an 8-bit storage area of VC0 to VC7 is assigned, and for each TC value, an 8-bit storage area of TC0 to TC7 is assigned.

As an EV flag, an EV value "0" or "1" is available. The EV value "0" represents a state where any key is not being pressed or released. The EV value "1" represents a state where any key is being pressed or released.

As a ST flag value, "0", "1", "2", "3", or "4" is available. The ST flag value "0" represents a status of waiting for a key press. The ST flag value "1" represents a status where a bias period (to be described below) is being counted. The ST flag value "2" represents a status where a velocity measurement value (to be described below) is being counted. The ST flag value "3" represents a status where a correction time counter value (to be described below) is being counted. The ST flag value "4" represents a status of waiting for a key release.

The EV flag set circuit 202 updates the EV flag values stored in the counter memory 208, through a path shown by "TO MEMORY INPUT" and "MEMORY INPUT" in FIG. 2, according to control of the controller 201.

The status update circuit 203 updates the ST flag values stored in the counter memory 208, through the path shown by "TO MEMORY INPUT" and "MEMORY INPUT" in FIG. 2, according to control of the controller 201.

When the first contact node 115 of each key of the key switch matrix 114 is turned on, the controller 201 issues a count start instruction, and the first counter adder 204 sequentially adds (counts up) a corresponding VC value stored in the counter memory 208, through the path shown by "TO MEMORY INPUT" and "MEMORY INPUT" in FIG. 2, according to regular timer interruptions, until a corresponding second contact node 116 is turned on. Also, the first counter adder 204 resets a VC value stored in association with each key of the key switch matrix 114 in the counter memory 208, according to control of the controller 201.

Similarly, when the second contact node 116 of each key of the key switch matrix 114 is turned on, the controller 201 issues a count start instruction, and the third counter adder 206 sequentially adds (counts up) a corresponding VC value stored in the counter memory 208, through the path shown by "TO MEMORY INPUT" and "MEMORY INPUT" in FIG. 2, according to regular timer interruptions, until a corresponding third contact node 117 is turned on. Also, the third counter adder 206 resets a VC value stored in association with each key of the key switch matrix 114 in the counter memory 208, according to control of the controller 201.

Here, each VC value in the counter memory 208 represents a bias period when a corresponding ST flag value is "1"; whereas it represents a velocity measurement value when the corresponding ST flag value is "2". That is, a velocity measurement value is a value representing a period obtained by subtracting a predetermined bias period from a period from when a first contact node 115 or a second contact node 116 is turned on to when a corresponding second contact node 116 or a corresponding third contact node 117 is turned on.

When the second contact node 116 of each key of the key switch matrix 114 is turned on and a corresponding velocity value is greater than a threshold value, the controller 201 issues a count start instruction, and the second counter adder 205 sequentially adds (counts up) a corresponding TC value stored in the counter memory 208, through the path shown by "TO MEMORY INPUT" and "MEMORY INPUT" in FIG. 2, according to regular timer interruption, until the arrival comparator circuit 210 detects that the current value of the corresponding TC value in the counter memory 208 coincides with a set value of the arrival time memory 209. Also, the second counter adder 205 resets a TC value stored in association with each key of the key switch matrix 114 in the counter memory 208, according to control of the controller 201.

Similarly, when the third contact node 117 of each key of the key switch matrix 114 is turned on, the controller 201 issues a count start instruction, and the fourth counter adder 207 sequentially adds (counts up) a corresponding TC value stored in the counter memory 208, through the path shown by "TO MEMORY INPUT" and "MEMORY INPUT" in FIG. 2, according to regular timer interruption, until the arrival comparator circuit 210 detects that the current value of the corresponding TC value in the counter memory 208 coincides with a set value of the arrival time memory 209. Also, the fourth counter adder 207 resets a TC value stored in association with each key of the key switch matrix 114 in the counter memory 208, according to control of the controller 201.

The first counter adder 204, the second counter adder 205, the third counter adder 206 and the fourth counter adder 207 may count a time between a count start and a count end.

For each key of the key switch matrix 114, the arrival time memory 209 stores an arrival time value representing a predetermined addition end time of the second counter adder 205 or the fourth counter adder 207 according to a velocity measurement value determined by the controller 201. When the second contact node 116 or the corresponding third contact node 117 of each key is turned on, a velocity value is determined, and an arrival time value is calculated by the controller 201 and is set in the arrival time memory 209.

With respect to each key of the key switch matrix 114, the arrival comparator circuit 210 compares a corresponding arrival time value stored in the arrival time memory 209 with the current value of a corresponding TC value stored in the counter memory 208, and transmits a coincidence signal to the controller 201 when the corresponding arrival time value and the TC value coincide with each other.

Figure 4:
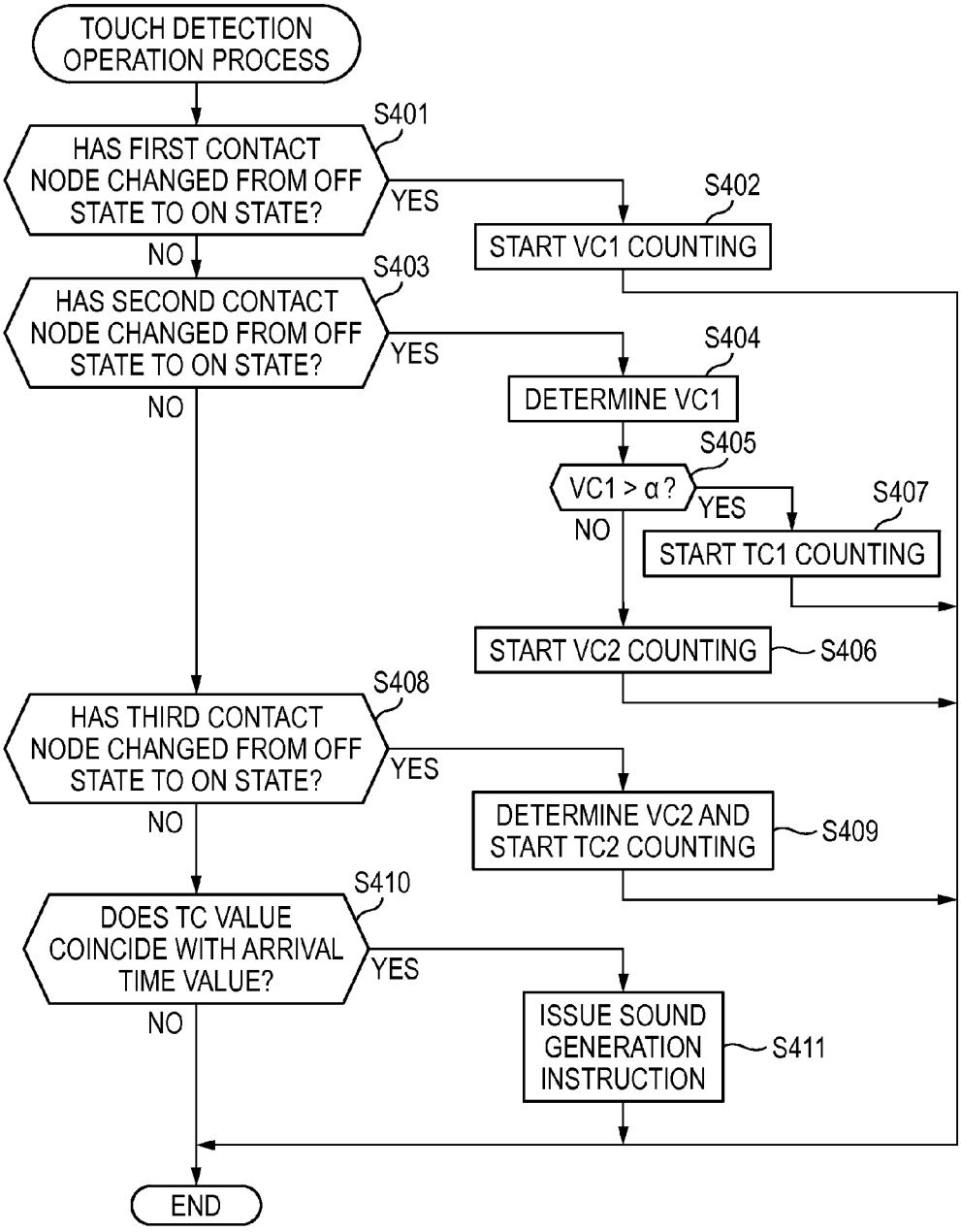
FIG. 4 is a flow chart illustrating an example of a touch detection operation process according to the embodiment.

FIG. 4 is a flow chart illustrating an example of a touch detection operation process of the touch detecting device 113 of FIG. 1 having the hardware configuration shown as an example in FIG. 2. This process is implemented as an operation of the controller 201 of the touch detecting device 113 to execute a touch detection operation process program (not especially shown). With respect to each key of the key switch matrix 114, the controller 201 repeatedly scans its touch state. Whenever the controller performs scanning, it calls the touch detection operation process program and scans the corresponding key, thereby detecting the touch state of the current scan target key.

In an initial state where any key is not being pressed, in the storage areas of the counter memory 208 shown in FIG. 3 and corresponding to all keys, every EV flag is reset to a value "0" representing that any key press or release event is not occurring, and every ST flag is reset to a value "0" representing the pressed states of the keys, and every VC value and every TC value are reset to a value "0".

When the touch detection operation process is activated, first, in STEP S401, the controller 201 determines whether a first contact node ON signal has been received from a current scan target key of the key switch matrix 114, thereby determining whether a corresponding first contact node 115 has changed from an OFF state to an ON state.

In a case that a first contact node ON signal has been received (a case of "YES" in the determination of STEP S401), that is, in a case that the corresponding first contact node 115 has changed from the OFF state to the ON state, the controller 201 stores the note number of the current scan target key in the note number register 212. Also, in view of a case that a plurality of keys is pressed at the same time, the note number register 212 may be configured to be able to store note numbers corresponding to the plurality of keys. Thereafter, the controller 201 controls the EV flag set circuit 202 such that the EV flag set circuit resets an EV flag value stored in association with the current scan target key in the counter memory 208 to a value "1" representing occurrence of a key press or release event. Further, the controller 201 controls the status update circuit 203 such that the status update circuit resets a ST flag value stored in association with the current scan target key in the counter memory 208 to a value "1" representing that key press bias counting is being performed. Furthermore, the controller 201 controls the first counter adder 204 such that the first counter adder resets a VC value stored in association with the current scan target key in the counter memory 208 and starts an adding operation (counting operation). In the case that the ST flag is "1", the VC value represents a bias period. The bias period is counted for removing an instable operation in touch detection at the first contact node 115. Even though a detailed flow chart is omitted, in a case that the VC value stored in association with the current scan target key in the counter memory 208 reaches a value predetermined as a bias period, the controller 201 controls the status update circuit 203 such that the status update circuit sets the ST flag value in association with the current scan target key in the counter memory 208 to a value "2" representing that velocity counting is being performed. Further, the controller 201 controls the first counter adder 204 such that the first counter adder resets the VC value stored in association with the current scan target key in the counter memory 208 and restarts an adding operation (counting operation). Therefore, after a touch at the first contact node 115 is detected, a velocity is measured with the exception of the bias period. In the case that the first contact node ON signal has been received, in STEP S402 of FIG. 4, the controller 201 starts counting of the VC value stored in association with the current scan target key in the counter memory 208 (this hereinafter will be referred as "VC1 counting") as described above. Thereafter, the controller 201 finishes the touch detection operation process on the current scan target key. Since then, the first counter adder 204 counts up the VC value (VC1 count value) stored in the counter memory 208, according to regular timer interruptions, until a corresponding second contact node 116 is turned on.

In a case that it is determined that any first contact node ON signal has not been received (a case of "NO" in STEP S401), that is, in every case except the case that the first contact node 115 has changed from the OFF state to the ON state, in STEP S403, the controller 201 determines whether a second contact node ON signal has been received from the current scan target key of the key switch matrix 114, thereby determining whether the corresponding second contact node 116 has changed from an OFF state to an ON state.

In a case that a second contact node ON signal has been received (a case of "YES" in the determination of STEP S403), that is, in a case that the corresponding second contact node 116 has changed from the OFF state to the ON state, in STEP S404, the controller 201 determines the VC1 count corresponding to the current scan target key. Specially, the controller 201 performs an inversion process (reciprocal calculation) on the VC value stored in association with the current scan target key in the counter memory 208, thereby calculating a velocity value (this value is referred to as a "VC1 value"), and stores that VC1 value in the velocity register 211. That is, a value proportional to a time period from when the first contact node 115 of the current scan target key was turned on to when the second contact node 116 of the current scan target key was turned on is stored as the VC1 value in the velocity register 211. Also, it is assumed that storage addresses of the note number register 212 are associated with storage addresses of the velocity register 211, respectively, and thus it is possible to recognize which velocity value in the velocity register 211 corresponds to what note number.

Subsequently, in STEP S405, the controller 201 determines whether the VC1 value is greater than a predetermined threshold value $\alpha$.

In a case that the VC1 value is not greater than the predetermined threshold value $\alpha$ (a case of "NO" in the determination of STEP S405), in order to further monitor a key pressing operation on the current scan target key from the second contact node 116 to the third contact node 117, the controller 201 controls the status update circuit 203 such that the status update circuit sets the ST flag value stored in association with the current scan target key in the counter memory 208 to a value "1" representing that key press bias counting is being performed. Further, the controller 201 controls the third counter adder 206 such that the third counter adder resets the VC value stored in association with the current scan target key in the counter memory 208 and starts an adding operation (counting operation). Similarly in the case of STEP S402, in the case that the ST flag is "1", the VC value represents a bias period. The bias period is counted for removing an instable operation in touch detection at the second contact node 116. Even though a detailed flow chart is omitted, in the case that the VC value stored in association with the current scan target key in the counter memory 208 reaches the value predetermined as a bias period, the controller 201 controls the status update circuit 203 such that the status update circuit sets the ST flag value stored in association with the current scan target key in the counter memory 208 to a value "2" representing that velocity counting is being performed. Further, the controller 201 controls the third counter adder 206 such that the third counter adder resets the VC value stored in association with the current scan target key in the counter memory 208 and restarts an adding operation (counting operation). Therefore, after a touch at the second contact node 116 is detected, a velocity is measured with the exception of the bias period. In a case that the second contact node ON signal has been received and the VC1 value is not greater than the predetermined threshold value α, that is, in a case that the current scan target key is being pressed but the press strength is not so high, in STEP S406 of FIG. 4, in order to monitor a key pressing operation from the second contact node 116 to the third contact node 117, the controller 201 starts counting of the VC value stored in association with the current scan target key in the counter memory 208 (this hereinafter will be referred as "VC2 counting") as described above. Thereafter, the controller 201 finishes the touch detection operation process on the current scan target key. Since then, the third counter adder 206 counts up the VC value (VC2 count value) stored in the counter memory 208, according to regular timer interruptions, until the third contact node 117 is turned on.

In a case that the VC1 value is greater than the predetermined threshold value α (a case of "YES" in the determination of STEP S405), in order to simulate an operation of an acoustic piano in which a hammer gets off an action part connected to a keyboard due to a strong key pressing operation, and moves and strikes a string by inertia, the controller 201 controls the status update circuit 203 such that the status update circuit sets the ST flag value stored in association with the current scan target key in the counter memory 208 to a value "3" representing that key press correction time counting is being performed. Thereafter, the controller 201 sets an arrival time value in the arrival time memory 209. This arrival time value is obtained by simulating a time required for a hammer of an acoustic piano to get off an action part connected to a keyboard due to a strong key pressing operation, and move and strike a string by inertia. The controller 201 calculates that arrival time as a time required for the current scan target key to move from the second contact node 116 to a defined lower limit stroke position at a velocity of the VC1 value determined in the process of STEP S404. Further, the controller 201 controls the second counter adder 205 such that the second counter adder resets the TC value stored in association with the current scan target key in the counter memory 208 and starts an adding operation (counting operation). In the case that the second contact node ON signal has been received and the VC1 value is greater than the predetermined threshold value α, that is, in a case that the current scan target key has been strongly pressed, in order to simulate an operation of an acoustic piano in which a hammer gets off an action part connected to a keyboard due to a strong key pressing operation, and moves and strikes a string by inertia, in STEP S407 of FIG. 4, the controller 201 starts counting of the TC value stored in association with the current scan target key in the counter memory 208 (this hereinafter will be referred as "TC1 counting") as described above. Thereafter, the controller 201 finishes the touch detection operation process on the current scan target key. Since then, the second counter adder 205 counts up the TC value (TC1 count value) stored in the counter memory 208, according to regular timer interruptions, until the arrival comparator circuit 210 detects that the TC value corresponding to the current scan target key and the arrival time value stored in the arrival time memory 209 coincide with each other.

In a case that it is determined that any second contact node ON signal has not been received (a case of "NO" in STEP S403), that is, in a case that the second contact node 116 has changed from the OFF state to the ON state, in STEP S408, the controller 201 determines whether a third contact node ON signal has been received from the current scan target key of the key switch matrix 114, thereby determining whether the corresponding third contact node 117 has changed from an OFF state to an ON state.

In a case that a third contact node ON signal has been received (a case of "YES" in the determination of STEP S408), that is, in every case except a case that the corresponding third contact node 117 has changed from the OFF state to the ON state, the controller 201 determines the VC2 count corresponding to the current scan target key. Specially, the controller 201 performs an inversion process (reciprocal calculation) on the VC value stored in association with the current scan target key in the counter memory 208, thereby calculating a velocity value (this value is referred to as a "VC2 value"), and stores that VC2 value in the velocity register 211. That is, a value proportional to a time period from when the second contact node 116 of the current scan target key was turned on to when the third contact node 117 of the current scan target key was turned on is stored as the VC2 value in the velocity register 211. Also, the controller 201 controls the status update circuit 203 such that the status update circuit sets the ST flag value stored in association with the current scan target key in the counter memory 208 to a value "3" representing that key press correction time counting is being performed. Thereafter, the controller 201 sets an arrival time value in the arrival time memory 209. The controller 201 calculates that arrival time as a time required for the current scan target key to move from the third contact node 117 to the defined lower limit stroke position at a velocity of the determined VC2 value. Further, the controller 201 controls the fourth counter adder 207 such that the fourth counter adder resets the TC value stored in association with the current scan target key in the counter memory 208 and starts an adding operation (counting operation). In the case that the third contact node ON signal has been received, in order to simulate a key pressing operation of an acoustic piano, in STEP S409 of FIG. 4, the controller 201 starts counting of the TC value stored in association with the current scan target key in the counter memory 208 (this hereinafter will be referred as "TC2 counting") as described above. Thereafter, the controller 201 finishes the touch detection operation process on the current scan target key. Since then, the fourth counter adder 207 counts up the TC value (TC2 count value) stored in the counter memory 208, according to regular timer interruptions, until the arrival comparator circuit 210 detects that the TC value corresponding to the current scan target key and the arrival time value stored in the arrival time memory 209 coincide with each other.

In a case that it is determined that any third contact node ON signal has not been received (a case of "NO" in STEP S408), that is, in every case except the case that the third contact node 117 has changed from the OFF state to the ON state, in STEP S410, with respect to the current scan target key of the key switch matrix 114, the controller 201 determines whether the arrival comparator circuit 210 has detected coincidence of the TC value in the counter memory 208 and the arrival time value in the arrival time memory 209.

In a case that the arrival comparator circuit 210 has detected coincidence with respect to the current scan target key (a case of "YES" in the determination in STEP S410), the controller 201 reads a note number and a velocity value corresponding to that key, from the note number register 212 and the velocity register 211. Thereafter, the controller 201 gives an interruption notification to the CPU 101 of FIG. 1 by an event interruption signal ("INTERRUPTION EV" of FIG. 2), thereby transmitting sound generation information including the note number and the velocity value to the CPU 101 and issuing a sound generation instruction in STEP S411. Finally, with respect to the current scan target key, the controller 201 sets a value "4" representing a status of waiting for a key release, in the ST flag in the counter memory 208. Thereafter, the controller 201 finishes the touch detection operation process on the current scan target key. In response to this, the CPU 101 issues a musical sound generation instruction based on the sound generation information noticed from the controller 201 included in the touch detecting device 113, to the sound source 112.

In a case that any third contact node ON signal has not been received (a case of "NO" in the determination of STEP S410), the controller 201 finishes the touch detection operation process on the current scan target key.

A sound muffling operation process during a key release related to the touch detection operation process during a key press described above is not related to the present invention, and thus will not be described in detail. In a case that a value "4" representing a status of waiting for a key release is stored as the ST flag in association with the current scan target key in the counter memory 208, when the controller 201 receives a first contact node OFF signal representing that the first contact node 115 is off, from the key switch matrix 114, as a general operation during a key release, the controller 201 performs a key release process. For example, the controller 201 reads the note number corresponding to that key, from the note number register 212. The controller 201 gives an interruption notification to the CPU 101 of FIG. 1 by an event interruption signal ("INTERRUPTION EV" of FIG. 2), thereby transmitting sound muffling information including the above described note number to the CPU 101 and issuing a sound muffling instruction. Finally, with respect to the current scan target key, the controller 201 sets a value "0" representing a status of waiting for a key press, in the ST flag in the counter memory 208. In response to this, the CPU 101 issues a musical sound muffling instruction based on the sound muffling information noticed from the controller 201 included in the touch detecting device 113, to the sound source 112. Also, in a case that the third contact node 117, the second contact node 116, and the first contact node 115 are sequentially released, the controller 201 may calculate a velocity value on the basis of periods between those contact nodes, in the same way as that during a key press, and transmit the calculated velocity value as a velocity value during the key release to the CPU 101, and the CPU 101 may perform velocity control during the key release on the sound source 112.

Figure 5:
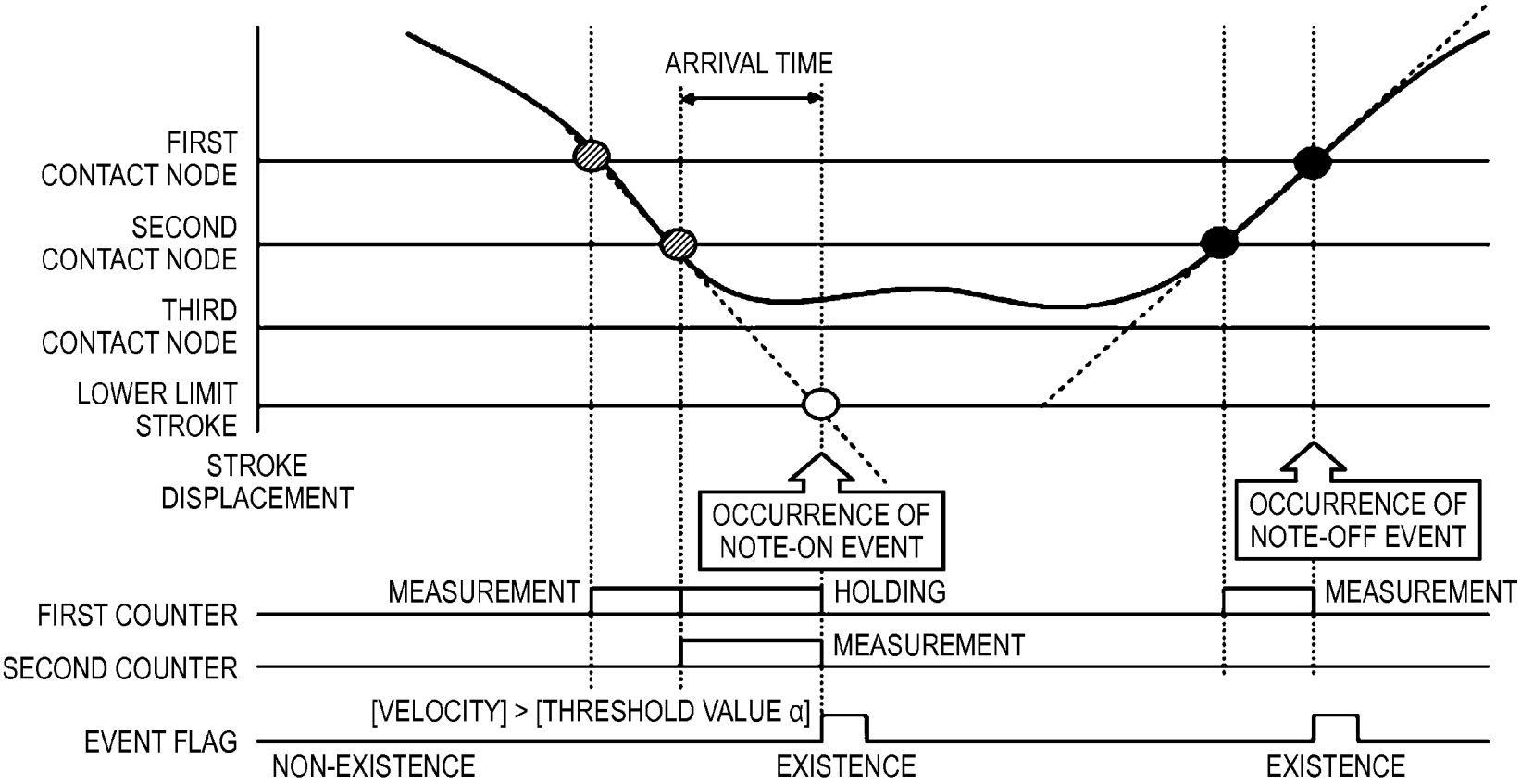
FIG. 5 is an explanatory view illustrating an operation of the embodiment in a case that a sound is generated by pressing a key to a shallow position.

An example of an operation of the present embodiment based on the touch detection operation process described above will be described below. FIG. 5 is an explanatory view illustrating an operation of the present embodiment in a case that a sound is generated by pressing a key to a shallow position. A case that a key has passed a first contact node 115 and a second contact node 116 but has not reached a third contact node 117, and thus a velocity VC1 value having been measured between the first contact node 115 and the second contact node 116 by the first counter adder 204 is greater than the predetermined threshold value $\alpha$ (that is, a count value corresponding to a time from when the first contact node 115 is turned on to when the second contact node 116 is turned on, measured by the first counter adder 204, is less than a predetermined threshold X) is considered as corresponding to a state of an acoustic piano in which a hammer gets off the action part connected to a keyboard due to a strong key pressing operation, and moves and strikes a string by inertia. In this case, by a series of control processes of STEPS S403, S404, S405, and S407 of FIG. 4, a lower limit stroke position arrival time estimated on the basis of the VC1 count value measured between the first contact node 115 and the second contact node 116 is counted by the second counter adder 205 (TC1 counting). When the TC value in the counter memory 208 coincides with the arrival time due to that counting, a note-on event in which the VC1 value is determined as a velocity value occurs according to a series of control processes of STEPS S410 and S411 of FIG. 4. Also, since the first contact node 115 is off, a note-off (damper-on) event occurs.

As described above, according to the present embodiment, it becomes possible to simulate an operation of an acoustic piano in which, even though a key is not pressed to the lower limit position, when a velocity value is large, a hammer gets off an action part connected to a keyboard and moves and strikes a string by inertia, thereby generating a sound, and it becomes possible to implementing detection of key pressing or a repetition of key pressing with a higher degree of accuracy.

Figure 6:
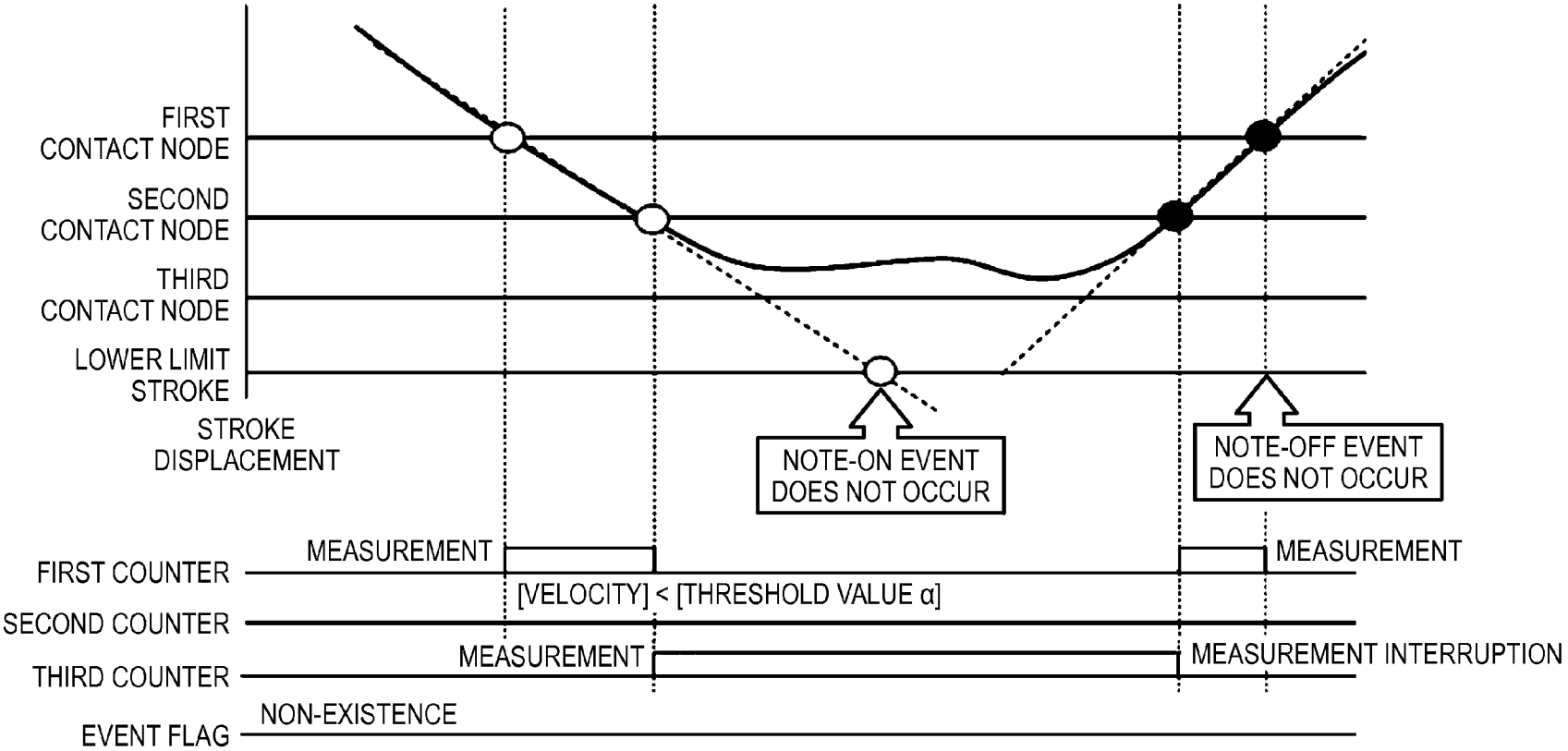
FIG. 6 is an explanatory view illustrating an operation of the embodiment in a case that a sound is not generated by pressing a key to a shallow position.

FIG. 6 is an explanatory view illustrating an operation of the embodiment in a case that a sound is not generated by pressing a key to a shallow position. There is a case that a key has passed a first contact node 115 and a second contact node 116 but has not reached a third contact node 117, and thus a velocity VC1 value measured between the first contact node 115 and the second contact node 116 by the first counter adder 204 is not greater than the predetermined threshold value $\alpha$ (that is, the count value corresponding to the time from when the first contact node 115 is turned on to when the second contact node 116 is turned on, measured by the first counter adder 204, is not less than the predetermined threshold X). In this case, by a series of control processes of STEPS S403, S404, S405, and S406 of FIG. 4, the second counter adder 205 does not start TC1 counting but the third counter adder 206 starts VC2 counting. As a result, a struck string does not reach the third contact node 117, and the second contact node 116 and the first contact node 115 are sequentially turned off. Therefore, the determination of STEP S410 of FIG. 4 does not become "YES", and thus a note-on event does not occur. Accordingly, a note-off event does not occur.

That is, it becomes possible to simulate an operation of an acoustic piano in which, a key is not pressed to a lower limit position and a velocity value is small, a hammer does not get off an action part connected to a keyboard, and thus string striking is not performed and any sound is not generated.

Figure 7:
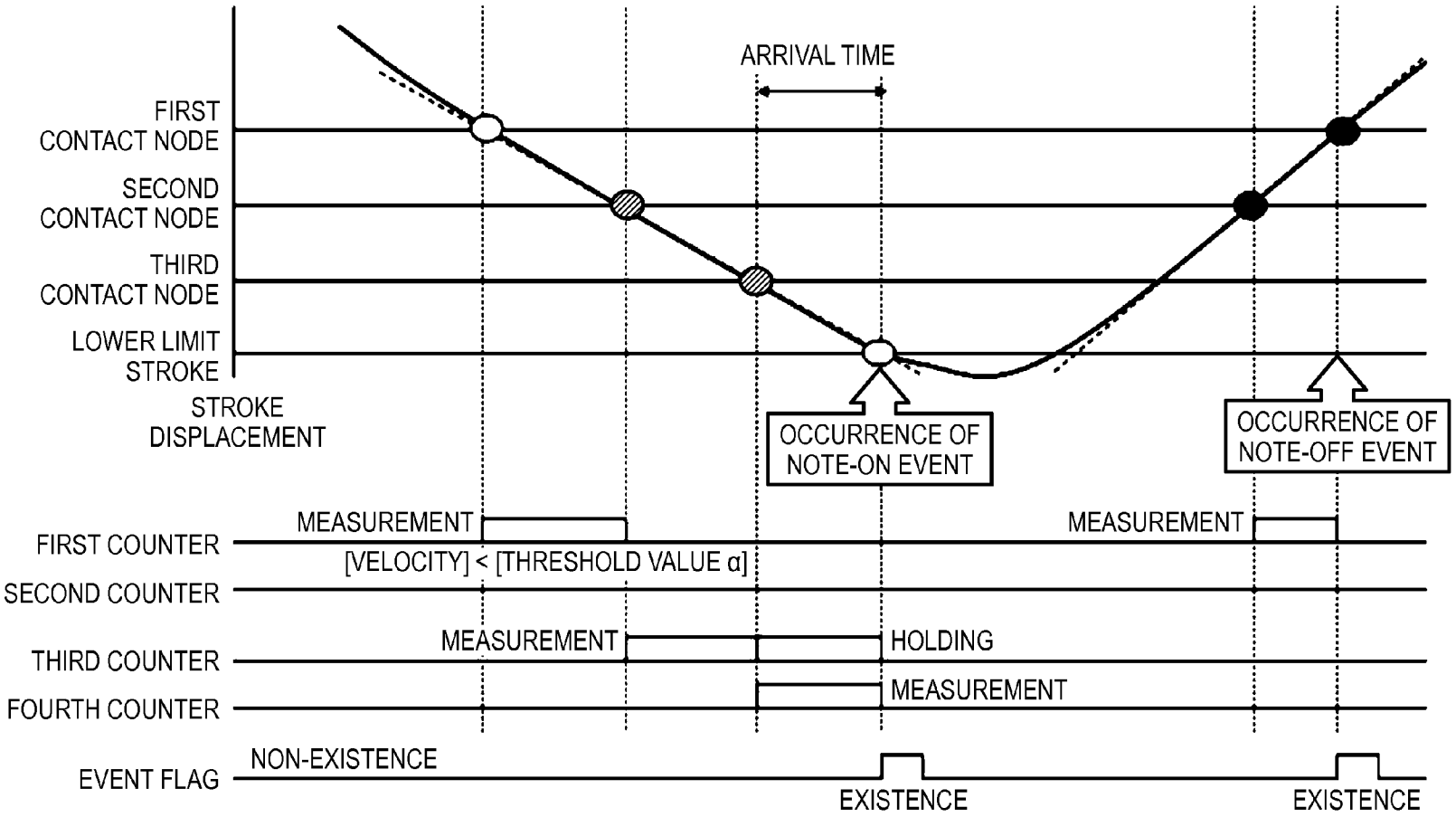
FIG. 7 is an explanatory view illustrating an operation of the embodiment in a case that a sound is generated because a pressed key has reached a third contact node even though a velocity between first and second contact nodes had been less than a threshold value.

FIG. 7 is an explanatory view illustrating an operation of the present embodiment in a case that a sound is generated since a pressed key has reached a third contact node 117 even though a VC1 count value between a first contact node 115 and a second contact node 116 was not greater than the threshold value $\alpha$ (that is, that the count value corresponding to the time from when the first contact node 115 is turned on to when the second contact node 116 is turned on, measured by the first counter adder 204, is not less than the predetermined threshold X). Since a velocity VC1 value measured between the first contact node 115 and the second contact node 116 by the first counter adder 204 when the key passed the first contact node 115 and the second contact node 116 is not greater than the threshold value α, by a series of control processes of STEPS S403, S404, S405, and S406 of FIG. 4, the second counter adder 205 does not start TC1 counting but the third counter adder 206 starts VC2 counting. In this state, when the pressed key passes the third contact node 117, by a series of control processes of STEPS S408 and S409 of FIG. 4, a lower limit stroke position arrival time estimated on the basis of a VC2 value measured between the second contact node 116 and the third contact node 117 is counted by the fourth counter adder 207 (TC2 counting). When the TC value in the counter memory 208 coincides with the arrival time due to that counting, a note-on event in which the VC2 value is determined as a velocity value occurs by a series of control processes of STEPS S410 and S411 of FIG. 4. Also, since the first contact node 115 is off, a note-off (damper-on) event occurs.

Figure 8:
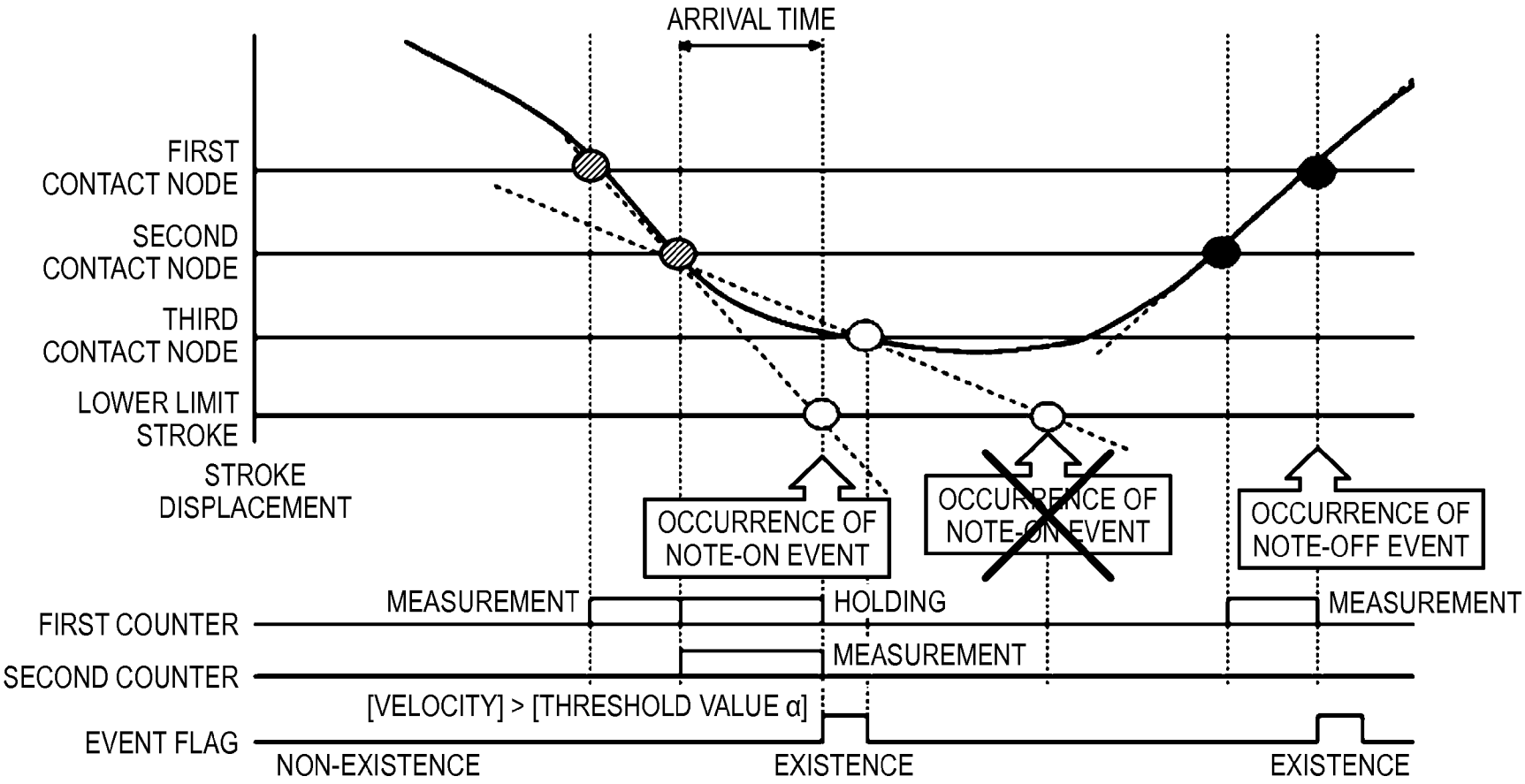
FIG. 8 is an explanatory view illustrating an operation of the embodiment in a case that a pressed key passes a third contact node while a velocity value exceeds the threshold value.

FIG. 8 is an explanatory view illustrating an operation of the present embodiment in a case that a VC1 value exceeds the threshold value α (that is, a count value corresponding to the time from when the first contact node 115 is turned on to when the second contact node 116 is turned on, measured by the first counter adder 204, is less than a predetermined threshold X) and a pressed key passes a third contact node 117. In this case, the same operation as that in FIG. 5 is performed. As described with reference to FIG. 5, this case is also considered as corresponding to a state of an acoustic piano in which a hammer gets off an action part connected to a keyboard due to a strong key pressing operation, and moves and strikes a string by inertia. Therefore, by a series of control processes of STEPS S403, S404, S405, and S407 of FIG. 4, the second counter adder 205 starts TC1 counting, and the third counter adder 206 does not start VC2 counting. Therefore, the touch state of the third contact node 117 is ignored. As a result, similarly in the case of FIG. 5, when the TC value in the counter memory 208 coincides with the arrival time, a note-on event in which the VC1 count value is determined as a velocity value occurs by a series of control processes of STEPS S410 and S411 of FIG. 4. Also, since the first contact node 115 is off, a note-off (damper-on) event occurs.

FIG. 9 is a table illustrating a summary of the operations of the cases of FIGS. 5 to 8 described above. In a case that the VC1 value measured between a first contact node 115 and a second contact node 116 is greater than the threshold value α, regardless of whether a pressed key does not reach a third contact node 117 (the case of FIG. 5) or reaches the third contact node 117 (the case of FIG. 8), a sound generation instruction is issued by the velocity value VC1 measured between the first contact node 115 and the second contact node 116. This corresponds to a state of an acoustic piano in which a hammer gets off an action part connected to a keyboard due to a strong key pressing operation, and moves and strikes a string by inertia. Meanwhile, in a case that the VC1 count value is not greater than the threshold value α, when the pressed key does not reach the third contact node 117, a sound generation instruction is not issued (the case of FIG. 6); whereas when the pressed key reaches the third contact node 117, a sound generation instruction is issued by the velocity value VC1 measured between the second contact node 116 and the third contact node 117 (the case of FIG. 7).

What is claimed is:

1. A touch detecting device comprising:

a first counter that counts a count value corresponding to a time from when a first contact node is turned on to when a second contact node is turned on in a case that at least two of the first contact node, the second contact node, and a third contact node are sequentially turned on according to a key pressing operation; and a control circuit that outputs a sound generation instruction signal regardless of whether the third contact node is turned on or off, in a case that the count value counted by the first counter is less than a threshold value, and that outputs the sound generation instruction signal after the third contact node is turned on, in a case that the count value counted by the first counter is not less than the threshold value.

2. The touch detecting device according to claim 1, further comprising:

a second counter that starts counting after the second contact node is turned on, wherein in the case that the count value counted by the first counter is not less than the threshold value, when a count value of the second counter reaches an arrival count value, the control circuit outputs the sound generation instruction signal.

3. The touch detecting device according to claim 1, wherein:

the sound generation instruction signal includes touch information.

4. The touch detecting device according to claim 2, wherein:

the sound generation instruction signal which is output when the count value of the second counter reaches the arrival count value includes touch information according to the count value of the first counter.

5. The touch detecting device according to claim 1, further comprising:

a third counter that counts a time from when the second contact node is turned on to when the third contact node is turned on, wherein the sound generation instruction signal which is output after the third contact node is turned on includes touch information according to a count value of the third counter.

6. The touch detecting device according to claim 5, further comprising:

a fourth counter that starts counting after counting of the third counter is completed, wherein in a case that the count value counted by the first counter is less than the threshold value, after the third contact node is turned on, when a count value of the fourth counter reaches an arrival count value, the control circuit outputs the sound generation instruction signal including touch information according to the count value of the third counter.

7. An electronic musical instrument comprising:

the touch detecting device according to claim 1;

a plurality of keys;

the first, second, and third contact nodes that are provided for the plurality of keys, respectively, and that are sequentially turned on according to a key pressing operation; and a sound source that generates a musical sound in response to a sound generation instruction from the touch detecting device.

8. A touch detecting method which is used in a touch detecting device including first, second, and third contact nodes, at least two of which are turned on according to a key pressing operation, and a first counter, wherein:

the touch detecting device counts a count value corresponding to a time from when the first contact node is turned on to when the second contact node is turned on, by the first counter, in a case that the count value counted by the first counter is less than a threshold value, regardless of whether the third contact node is turned on or off, the touch detecting device outputs a sound generation instruction signal, and in a case that the count value counted by the first counter is not less than the threshold value, after the third contact node is turned on, the touch detecting device outputs the sound generation instruction signal.

9. The touch detecting method according to claim 8, wherein:

the touch detecting device further includes a second counter which starts counting after the second contact node is turned on, and in the case that the count value counted by the first counter is not less than the threshold value, when a count value of the second counter reaches an arrival count value, the touch detecting device outputs the sound generation instruction signal.

10. The touch detecting method according to claim 8, wherein:

the sound generation instruction signal includes touch information.

11. The touch detecting method according to claim 9, wherein:

when the count value of the second counter reaches the arrival count value, the touch detecting device outputs the sound generation instruction signal including touch information according to the count value of the first counter.

12. The touch detecting method according to claim 9, wherein:

the touch detecting device further includes a third counter which counts a time from when the second contact node is turned on to when the third contact node is turned on, and after the third contact node is turned on, the touch detecting device outputs the sound generation instruction signal including touch information according to a count value of the third counter.

13. The touch detecting method according to claim 12, wherein:

the touch detecting device further includes a fourth counter which starts counting after counting of the third counter is completed, and in a case that the count value counted by the first counter is less than the threshold value, after the third contact node is turned on, when a count value of the fourth counter reaches an arrival count value, the touch detecting device outputs a sound generation instruction including touch information according to the count value of the third counter.

14. A non-transitory storage medium readable in a computer which is used as a touch detecting device including first, second, and third contact nodes, at least two of which are turned on according to a key pressing operation, and a first counter, and retaining a program making the computer perform the following steps:

a first step of counting a count value corresponding to a time from when the first contact node is turned on to when the second contact node is turned on, by the first counter;

a second step of outputting a sound generation instruction signal, regardless of whether the third contact node is turned on or off, in a case that the value counted by the first counter is less than a threshold value; and a third step of outputting the sound generation instruction signal after the third contact node is turned on, in a case that the value counted by the first counter is not less than the threshold value.

15. The storage medium according to claim 14, wherein:

the touch detecting device further includes a second counter which starts counting after the second contact node is turned on, and in the second step, in the case that the count value counted by the first counter is not less than the threshold value, when a count value of the second counter reaches an arrival count value, the sound generation instruction signal is output.

16. The storage medium according to claim 14, wherein:

the sound generation instruction signal includes touch information.

17. The storage medium according to claim 15, wherein:

when the count value of the second counter reaches the arrival count value, the touch detecting device outputs the sound generation instruction signal including touch information according to the count value of the first counter.

18. The storage medium according to claim 14, wherein:

the touch detecting device further includes a third counter which counts a time from when the second contact node is turned on to when the third contact node is turned on, and after the third contact node is turned on, the touch detecting device outputs the sound generation instruction signal including touch information according to a count value of the third counter.

19. The storage medium according to claim 18, wherein:

the touch detecting device further includes a fourth counter, which starts counting after counting of the third counter is completed, and in a case that the count value counted by the first counter is less than the threshold value, after the third contact node is turned on, when a count value of the fourth counter reaches an arrival count value, the touch detecting device outputs a sound generation instruction including touch information according to the count value of the third counter.

* * * * *